US005323301A

United States Patent [19]

Kaufman

[11] Patent Number: 5,323,301

[45] Date of Patent: Jun. 21, 1994

[54] DIMMABLE STUDIO LIGHTING DEVICE

[76] Inventor: Robert Kaufman, 4438 Camellia Ave., North Hollywood, Calif. 91602

[21] Appl. No.: 986,718

[22] Filed: Dec. 8, 1992

[51] Int. Cl.[5] ..... F21V 7/00

[52] U.S. Cl. ..... 362/287; 362/18; 362/281; 362/293; 362/297

[58] Field of Search ..... 362/287, 293, 281, 283, 362/321, 322, 297, 343, 346, 294, 16, 17, 18, 804

[56] References Cited

U.S. PATENT DOCUMENTS

| | | | |
|---|---|---|---|
| 1,045,063 | 11/1912 | Naujoks | 362/293 |
| 2,735,929 | 2/1956 | Erhardt et al. | 362/321 |
| 3,930,149 | 12/1975 | French | 362/293 |
| 3,944,320 | 3/1976 | McLintic | 362/293 |
| 4,048,493 | 9/1977 | Lee | 362/321 |
| 4,620,791 | 11/1986 | Combastet | 362/293 |
| 4,893,225 | 1/1990 | Solomon | 362/281 |
| 5,029,050 | 7/1991 | Bergkvist | 362/293 |
| 5,130,913 | 7/1992 | David | 362/293 |

FOREIGN PATENT DOCUMENTS

| | | | |
|---|---|---|---|
| 0405953 | 1/1991 | European Pat. Off. | 362/293 |

*Primary Examiner*—Ira S. Lazarus
*Assistant Examiner*—Y. Quach
*Attorney, Agent, or Firm*—Spensley Horn Jubas & Lubitz

[57] ABSTRACT

A studio lighting device for supplying light having a selected color temperature to a subject, comprising: an electrically powered light source connected to receive operating power which establishes a voltage across the source, the source being operative to produce light having a color temperature which varies as a function of the voltage; a first reflecting mirror for reflecting light in a first wavelength range, the first mirror being disposed at a location for reflecting a quantity of light from the source to the subject; a second reflecting mirror for reflecting light in a second wavelength range which is different from the first wavelength range, the second mirror being disposed at a location for reflecting a quantity of light from the source to the subject; and means connected for displacing the second reflecting mirror relative to the first reflecting mirror in order to alter the ratio between the quantity of light reflected to the subject by the first mirror and the quantity of light reflected to the subject by the second mirror.

12 Claims, 2 Drawing Sheets

DIMMABLE STUDIO LIGHTING DEVICE

BACKGROUND OF THE INVENTION

The present invention relates to studio lighting devices, i.e. devices for illuminating subjects for purposes of color photography or cinematography, or for other situations in which it is desirable to illuminate a subject with light having a selected color temperature.

In fields such as color photography and cinematography, the colors appearing in the final product, be it a photographic print or motion picture diapositive, will depend substantially on both the color temperature and the intensity of the light which illuminated the subject during filming.

One of the capabilities required of such a lighting device is that the intensity of the light which it emits be adjustable. Those familiar with electrically powered light sources are aware that, in the absence of special considerations, the most suitable manner of varying the light intensity produced by such a source is by varying the voltage of the operating power supply to the source. However, one characteristic of the light sources currently employed for these purposes is that the color temperature of the light which they produce varies as a function of this voltage. In particular, as the voltage decreases, the color temperature of the light output decreases. Therefore, although this simple technique can be used for monochrome photography and cinematography, it has not proven suitable for filming in color.

Thus, in view of the need to maintain the illumination at a given color temperature, the current practice in the art to employ a variety of techniques, includes the physical placement of light absorbing materials in front of the lighting devices, in order to vary intensity without varying color temperature. All of the techniques currently in use can be implemented only with difficulty, particularly with regard to lighting devices which are installed at a substantial distance above the floor.

It is also possible to vary the intensity of light from such a device by varying the cross-sectional area of the light beam. Specifically, if the width of the beam emitted by the device can be varied from that which is associated with a spotlight to that which is associated with a floodlight, without varying the total light being produced by the device, the intensity of the light reaching the subject will be decreased without altering the color temperature of the beam. However, this technique will permit only a limited adjustment and is not suitable in certain situations where it is desirable to not vary the width of the beam.

SUMMARY OF THE INVENTION

It is an object of the present invention to provide a lighting device which is free of the above-described drawbacks and difficulties.

Another object of the invention is to provide a lighting device which can produce light having a variable intensity and a substantially constant color temperature.

Another object of the invention is to provide a lighting device which can be controlled from a remote location.

Yet another object of the invention is to provide a lighting device which can emit a controlled quantity of light, with a substantially constant color temperature and without requiring a change in the width of the light beam.

These and other objects are achieved, according to the present invention, by a studio lighting device for supplying light having a selected color temperature to a subject, comprising: an electrically powered light source connected to receive operating power which establishes a voltage across the source, the source being operative to produce light having a color temperature which varies as a function of the voltage; a first reflecting mirror for reflecting light in a first wavelength range, the first mirror being disposed at a location for reflecting a quantity of light from the source to the subject; a second reflecting mirror for reflecting light in a second wavelength range which is different from the first wavelength range, the second mirror being disposed at a location for reflecting a quantity of light from the source to the subject; and means connected for varying the quantity of light reflected by the second reflecting mirror in order to alter the ratio between the quantity of light reflected to the subject by the first mirror and the quantity of light reflected to the subject by the second mirror.

DESCRIPTION OF THE PREFERRED EMBODIMENTS

Figure 2:
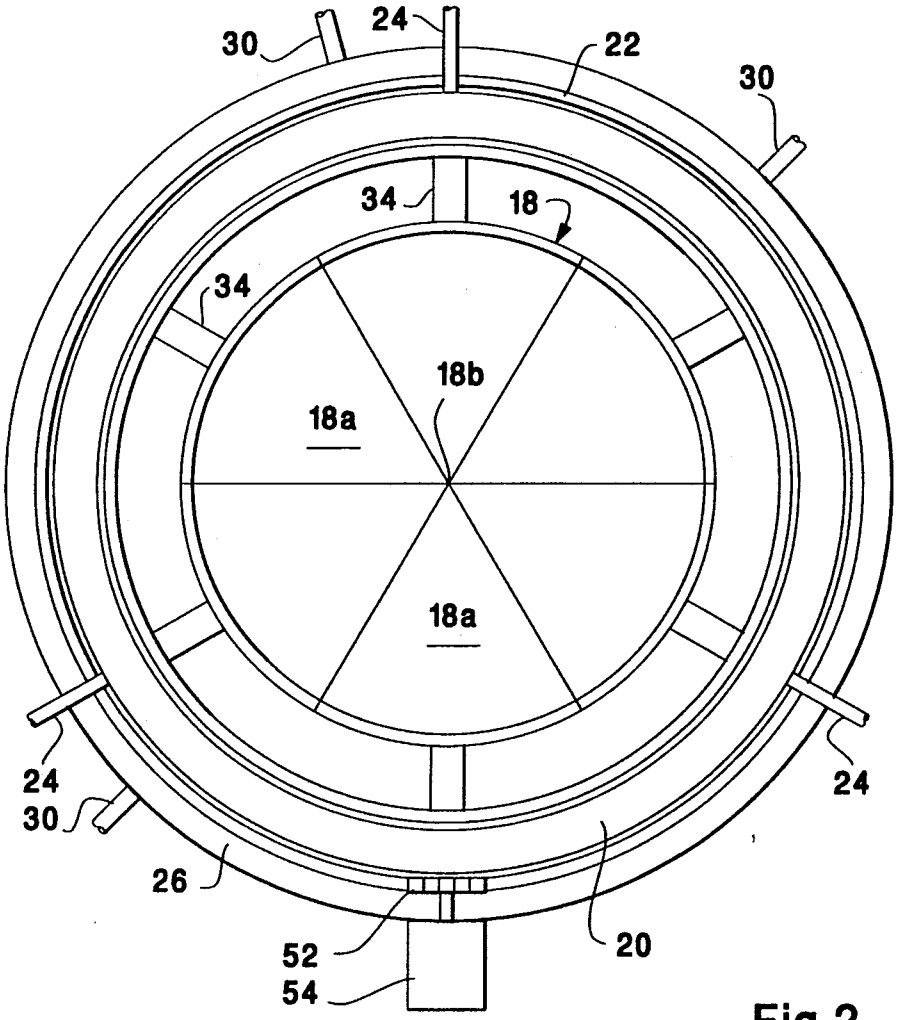
FIG. 2 is a front elevational view of the device of FIG. 1.
Figure 1:
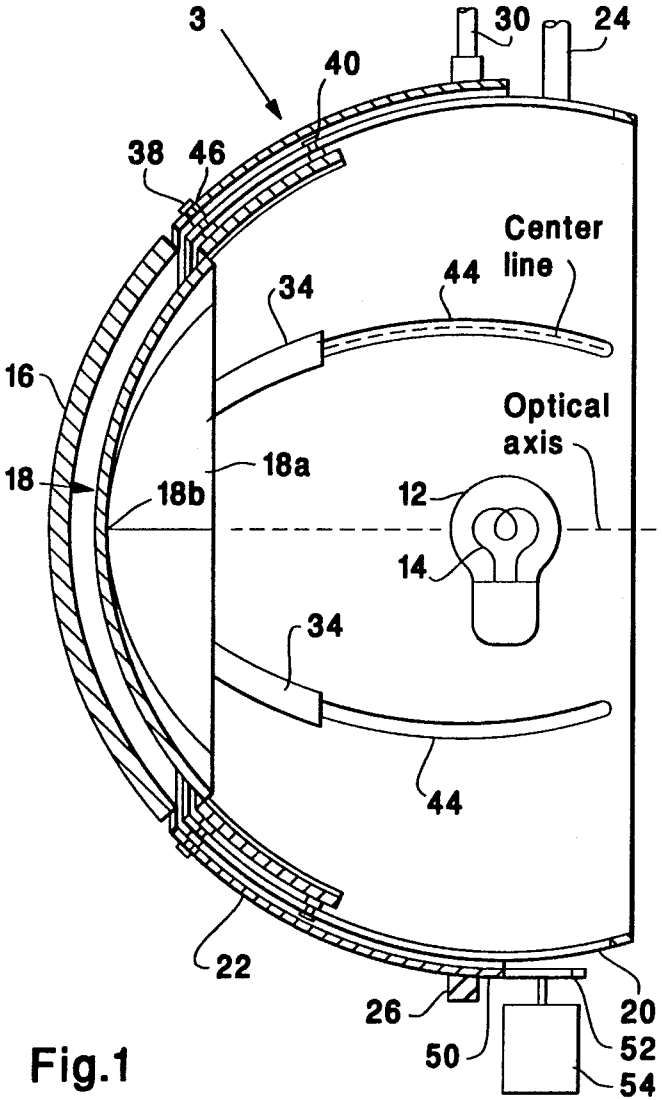
FIG. 1 is a cross-sectional side elevational view of a preferred embodiment of a lighting device according to the invention.

Referring, firstly, to FIGS. 1 and 2, the components illustrated in the drawing will be disposed in a housing provided with a lens selected to form light produced in a device into a beam having a suitable form. Both the housing and the lens are conventional components in the art and are not illustrated in the drawing for the sake of simplicity.

The only optical components illustrated in FIGS. 1 and 2 are a light source composed of a tube 12 enclosing a filament 14, a first dichroic mirror 16 and a second dichroic mirror 18.

Tube 12 is held in a conventional manner in a receptacle which is connected to supply operating power to filament 14. The receptacle (not shown) holding tube 12 may be mounted on a fixed platform in the device or may be mounted on a platform which can be displaced, as by a motor driven worm gear, along the optical axis of the device in order to vary the width of the beam issuing from the device, i.e. to vary the beam between a wide angle flood and a narrow angle spot.

First mirror 16 is fixed in position in the device housing, while second mirror 18 is made up of a plurality of segments. In the illustrated embodiment, there are six segments **18*a* mounted, in a manner to be described below, to be moved away from the center 18*b* of mirror 18 in order to allow mirror 16 to reflect a given quantity of the light emanating from tube 12**.

Thus, the light from tube 12 which initially travels toward mirrors 16 and 18 will be reflected and concentrated by one or both of mirrors 16 and 18, after which the light is directed toward the right and through the lens of the device.

In FIG. 2, tube 12 and filament 14 are not illustrated, again for the sake of simplicity, and mirror 16 is not visible.

To the extent possible, the reflecting surfaces of mirrors 16 and 18 should have the same curvature and should be as close together as possible so that the shape of the beam produced by the device will not be significantly altered as segments 18*a* of mirror 18 are displaced to expose a progressively increasing area of mirror 16. However, if the spacing between mirrors 16 and 18 would have a noticeable effect, mirror 18 can be formed to have a smaller radius of curvature than mirror 16. The radii of curvature and positions of mirrors 16 and 18 will normally be selected to cause the reflecting surfaces of both mirrors to have a common center of curvature coincident with filament 14, or with at least one position of filament 14 when tube 12 is mounted to be displaced, as described above.

The mechanism for displacing segments 18*a* will now be described. This mechanism includes a stationary cylinder 20 and a cylinder 22 mounted to rotate about the beam axis of the light source, which, in FIG. 1 is a horizontal line which extends through the midpoint of each of mirrors 16 and 18 and through filament 14. Preferably, each of cylinders 20 and 22 has a surface constituted by a portion of a sphere with the same radius of curvature as mirror 18. Stationary cylinder 20 may be supported by the device housing via struts 24. Cylinder 22 may be supported by a ring bearing 26 which can be secured to the device housing via struts 30.

Each segment 18*a* of mirror 18 is fixed to a respective plate 34 which carries two pins 38 and 40.

Cylinder 20 is provided with six slots 44 which are distributed regularly around the circumference of cylinder 20 and extend in the direction of the optical axis of the lighting device. More specifically, each slot 44 has a center line which lies in a plane containing the optical axis. Each of pins 38 and 40 has a reduced diameter portion, 38′, 40′, respectively, which is disposed within a respective one of slots 44 in order to retain pins 38 and 40 in slots 44.

Figure 3:
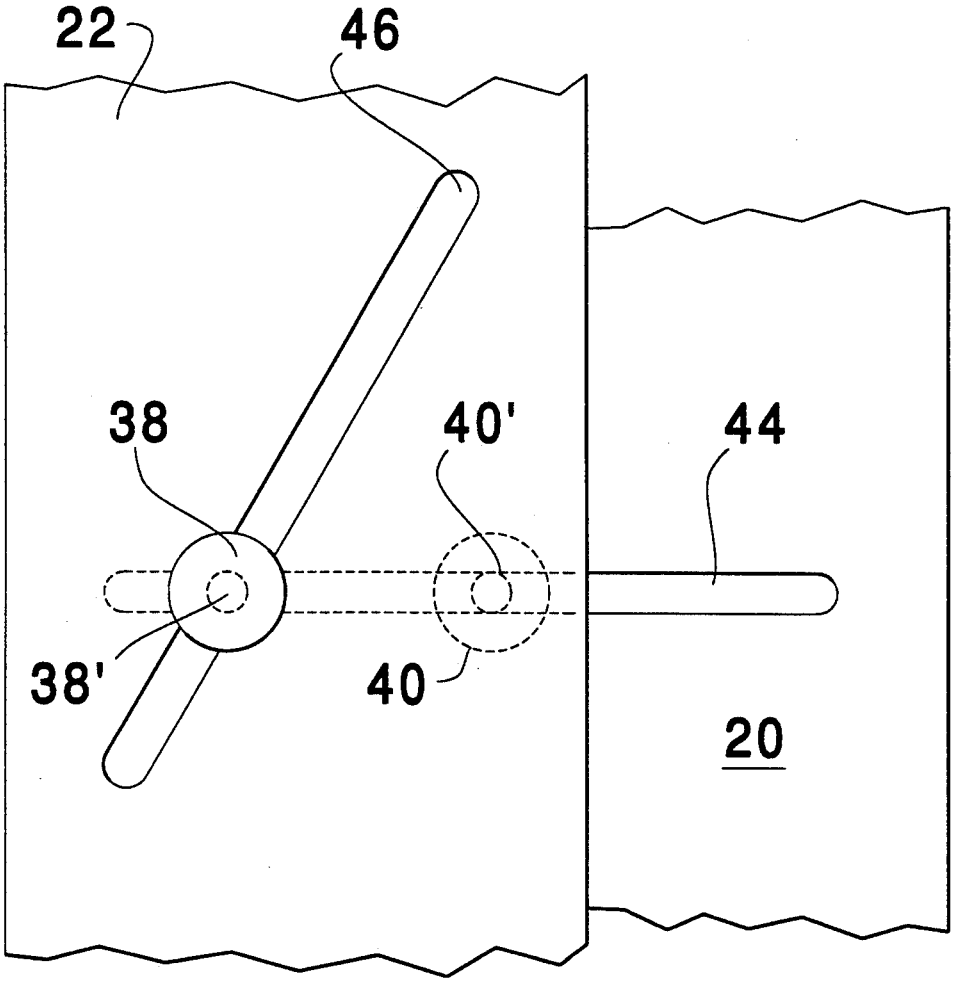
FIG. 3 is a detail view taken in the direction of the arrow 3 of FIG. 1.

In addition, cylinder 22 is provided with six slots 46 which are also equispaced around the circumference of cylinder 22 but which extend at an acute angle to the optical axis of the lighting device. Each pin 38 extends through a respective slot 46 and has a second reduced diameter portion 38′ which engages in the respective slot 46. The relation between a slot 44 in stationary cylinder 20 and a slot 46 in rotatably mounted cylinder 22 is depicted in FIG. 3, which also illustrates the manner in which pins 38 and 40 cooperate with slots 44 and 46.

Reverting to FIGS. 1 and 2, at least a portion of the large diameter edge of cylinder 22 is formed to have gear teeth 50 which will mesh with teeth of a gear wheel 52 mounted to be rotated by a motor 54. Upon rotation of gear wheel 52, cylinder 22 rotates about the optical axis of the device. As a result, as will be best appreciated from a consideration of FIG. 3, each slot 46 is displaced transversely of an associated slot 44, thereby driving pin 38 along its associated slot 44. Pin 40 also rides in slot 44 and maintains the proper orientation of its associated segment 18*a*.

Motor 54 is preferably part of a servo system which rotates cylinder 22 through an angle corresponding to the difference between the voltage presently applied to tube 12 and the rated voltage for that tube. Thus, as the voltage applied to tube 12 is reduced, in order to dim the light source, mirror segments 18*a* are moved progressively away from center point 18*b* so that an increasing portion of the light produced by tube 12 is reflected by mirror 16. In other words, motor 54 displaces segments 18*a* by an amount inversely proportional to the value of the voltage across the tube. Since mirror 16 is constructed to reflect light having a higher color temperature than mirror 18, the light wavelength components selectively reflected by mirror 16 will compensate for the reduced color temperature of the light being emitted by tube 12. By a suitable selection of the color temperature which mirror 16 is constructed to reflect and the relation between the voltage applied to tube 12 and the rotation produced by motor 54, a nearly perfect compensation can be achieved so that as dimming proceeds, the effective color temperature of the light emitted from the device remains substantially constant.

Figure 4:
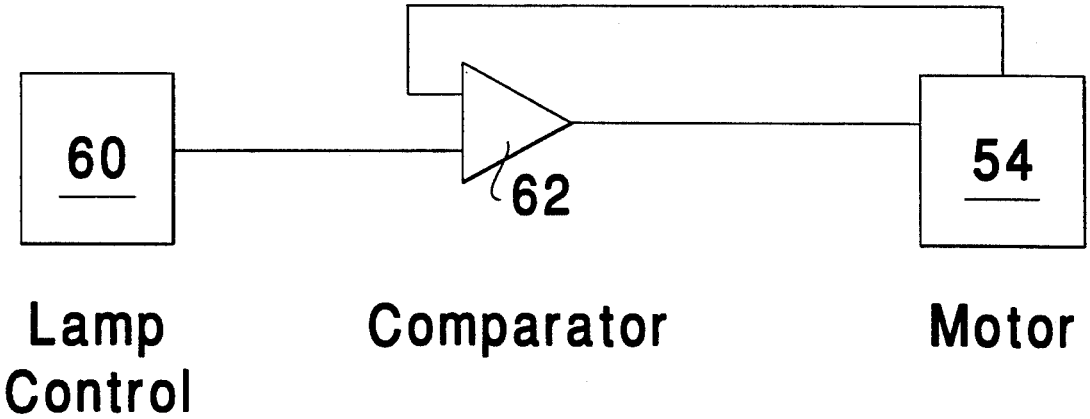
FIG. 4 is a block diagram of the control system employed in a device according to the invention.

As shown in FIG. 4, a lamp control device 60, which controls the voltage applied to lamp 12 , can produce a signal proportional to the above-mentioned voltage difference which signal is applied to a comparator 62. The output of comparator 62 provides a signal which drives motor 54 and as motor 54 rotates, an additional component associated with the motor, such as a potentiometer, is driven to provide a voltage proportional to the amount of rotation of motor 54 from a reference position. This signal is supplied to a second input of comparator 62. Thus, motor 54 will be driven in either direction in order to move segments 18*a* radially inwardly or outwardly, depending on the value of the voltage being applied to lamp 12.

According to a preferred embodiment of the invention, lamp 12 produces a nominal color temperature of 3200° K, i.e. when a rate of voltage is applied thereto. Mirror 18 is a dichroic mirror constructed to reflect light with a color temperature of 3200° K, while mirror 16 is a dichroic mirror constructed to reflect light at a color temperature of 5000°-6000° K.

Other mechanisms can be employed to displace the movable mirror segments. One such mechanism could be constructed to pivot the movable mirror segments in the manner of a camera lens diaphragm. The number of mirror segments could be greater or less than six.

In addition, depending on the directionality of the light emitted by the light tube, or bulb, 12, the mirrors could have a smaller diameter than that illustrated, which would permit the structure which supports the movable mirror segment, and particularly cylinder 20, to be made more compact.

According to other embodiments of the invention, mirror 18 could be constituted by a stationary mirror whose reflecting surface is constituted by a material, such as a liquid crystal, that can be subjected to an electric potential or current which gives the mirror a varying degree of transparency to the light produced by tube 12. Since the degree of transparency of a liquid crystal layer can be accurately controlled in this manner, the electric current or potential could be made to vary as a suitable function of the lamp voltage.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A studio lighting device for supplying light having a selected color temperature to a subject, comprising:

an electrically powered light source connected to receive operating power which establishes a voltage across said source electrically powered light, said electrically powered light source being operative to produce light having a color temperature which varies as a function of the voltage;

a first reflecting mirror for reflecting light in a first wavelength range, said first reflecting mirror being disposed at a location for reflecting a quantity of light from said electrically powered light source to the subject;

a second reflecting mirror for reflecting light in a second wavelength range which is different from the first wavelength range, said second reflecting mirror being disposed at a location for reflecting a quantity of light from said electrically powered light source to the subject; and means connected to said second reflecting mirror for varying the quantity of light reflected by said second reflecting mirror in order to alter the ratio between the quantity of light reflected to the subject by said first reflecting mirror and the quantity of light reflected to the subject by said second reflecting mirror.

2. A studio lighting device as defined in claim 1 wherein said electrically powered light source emits light at a given color temperature value when a given voltage value is established across said electrically powered light source and the color temperature of the light produced by said electrically powered light source decreases from the given temperature value as the voltage established across said electrically powered light source decreases from the given voltage value.

3. A studio lighting device as defined in claim 2 wherein said first reflecting mirror reflects light at a color temperature having a value higher than the given color temperature value and said second reflecting mirror reflects light at the given color temperature value.

4. A studio lighting device as defined in claim 3 further comprising control means connected to said means for varying the quantity of light for controlling operation of said means for varying the quantity of light in response to the voltage existing across said electrically powered light source.

5. A studio lighting device as defined in claim 4 wherein each of said first and second reflecting mirrors is a concave reflecting mirror, said second reflecting mirror is composed of a plurality of segments; and said means for varying the quantity of light comprise reflecting mirror segment displacing means coupled to said segments to move said segments away from one another in a manner to increase the quantity of light reflected from said electrically powered light source to the subject by said first reflecting mirror.

6. A studio lighting device as defined in claim 5 wherein said reflecting mirror segment displacing means comprise a motor for displacing said segments of said second reflecting mirror by an amount which varies inversely with the value of the voltage across said electrically powered light source.

7. A studio lighting device as defined in claim 1 further comprising control means connected to said means for varying the quantity of light for controlling operation of said means for varying the quantity of light in response to the voltage existing across said electrically powered light source.

8. A studio lighting device as defined in claim 7 wherein each of said first and second reflecting mirrors is a concave reflecting mirror; said second reflecting mirror is composed of a plurality of segments; and said means for varying the quantity of light comprise reflecting mirror segment displacing means coupled to said segments to move said segments away from one another in a manner to increase the quantity of light reflected from said electrically powered light source to the subject by said first reflecting mirror.

9. A studio lighting device as defined in claim 8 wherein said reflecting mirror segment displacing means comprise a motor for displacing said segments of said second reflecting mirror by an amount which varies inversely with the value of the voltage across said electrically powered light source.

10. A studio lighting device as defined in claim 1 wherein each of said first and second reflecting mirrors is a concave reflecting mirror; said second reflecting mirror is composed of a plurality of segments; and said means for varying the quantity of light comprise reflecting mirror segment displacing means coupled to said segments to move said segments away from one another in a manner to increase the quantity of light reflected from said electrically powered light source to the subject by said first reflecting mirror.

11. A studio lighting device as defined in claim 10 wherein said reflecting mirror segment displacing means comprise a motor for displacing said segments of said second reflecting mirror by an amount which varies inversely with the value of the voltage across said electrically powered light source.

12. A studio lighting device as defined in claim 10 wherein said reflecting mirror segment displacing means move said segments along paths which are parallel to said first reflecting mirror.

* * * * *